US007259510B1

(12) United States Patent
Gammel et al.

(10) Patent No.: US 7,259,510 B1
(45) Date of Patent: Aug. 21, 2007

(54) ON-CHIP VACUUM TUBE DEVICE AND PROCESS FOR MAKING DEVICE

(75) Inventors: Peter Ledel Gammel, Millburn, NJ (US); Richard Edwin Howard, Highland Park, NJ (US); Omar Daniel Lopez, Summit, NJ (US); Wei Zhu, Warren, NJ (US)

(73) Assignee: Agere Systems Inc., Allentown, PA (US)

( * ) Notice: Subject to any disclaimer, the term of this patent is extended or adjusted under 35 U.S.C. 154(b) by 439 days.

(21) Appl. No.: 09/651,696

(22) Filed: Aug. 30, 2000

(51) Int. Cl.
*H01J 19/00* (2006.01)

(52) U.S. Cl. ..... 313/497; 313/311; 313/309; 313/351; 313/336

(58) Field of Classification Search ..... 313/307–311, 313/336, 351, 495–497, 339; 310/309, 40, 310/308
See application file for complete search history.

(56) References Cited

U.S. PATENT DOCUMENTS

| | | | | |
|---|---|---|---|---|
| 4,728,851 | A * | 3/1988 | Lambe | 313/309 |
| 4,827,177 | A * | 5/1989 | Lee et al. | 313/306 |
| 5,363,021 | A | 11/1994 | MacDonald | |
| 5,386,172 | A * | 1/1995 | Komatsu | 313/309 |
| 5,536,988 | A * | 7/1996 | Zhang et al. | 310/309 |
| 5,637,539 | A | 6/1997 | Hofmann et al. | |
| 5,786,658 | A * | 7/1998 | Tsukamoto et al. | 313/309 |
| 5,955,828 | A | 9/1999 | Sadwick et al. | |
| 6,027,951 | A | 2/2000 | MacDonald et al. | |
| 6,034,810 | A | 3/2000 | Robinson et al. | |
| 6,522,055 | B2 * | 2/2003 | Uemura et al. | 313/310 |
| 6,630,772 | B1 * | 10/2003 | Bower et al. | 313/311 |
| 6,686,680 | B2 * | 2/2004 | Shaw et al. | 313/309 |
| 6,803,725 | B2 * | 10/2004 | Jin | 315/3.5 |

FOREIGN PATENT DOCUMENTS

| | | |
|---|---|---|
| EP | 0880077 A2 | 5/1998 |
| WO | WO98/44529 | 10/1998 |

OTHER PUBLICATIONS

I. Brodie, et al., "Vacuum microelectronics", *Advances in Electronics and Electron Physics*, vol. 83 (1992).
D.K. Lynn, et al., "Thermionic Integrated Circuits: Electroics For Hostile Environments", *IEEE Transactions on Nuclear Science*, vol. NS-32, No. 6 (1985).
Green, R. et al., "Vacuum Integrated Circuits", *IEDM 85*, pp. 172-175.

(Continued)

*Primary Examiner*—Ashok Patel

(57) ABSTRACT

A microelectromechanical microwave vacuum tube device is disclosed. The device consists of a cathode formed on a substrate, the cathode comprising electron emitters. A cathode emission control grid is also attached to the device substrate. The device further includes an output structure where amplified microwave power is removed from the device. In the device, the cathode surface and the grid surface are substantially parallel to each other and substantially perpendicular to the substrate. One of either the cathode, the grid, or both the cathode and the grid, are attached to the device substrate by one or more flexural members. The device further comprises an anode that is substantially parallel to the cathode surface and the grid surface.

13 Claims, 3 Drawing Sheets

OTHER PUBLICATIONS

Iannazzo, S., "A Survey Of The Present Status Of Vacuum Microelectronics", Solid-State Electronics, vol. 36, No. 3, pp. 301-320, Mar. 1, 1993.
Ren et al., "Synthesis of Large Arrays of Well-Aligned Carbon Nanotubes on Glass", *Science*, vol. 282, 1105 (1998).
Fan et al., "Self-Oriented Regular Arrays of Crbon Nanotubes and Their Field Emission Properties", *Science* vol. 283, 512 (1999).
Rinzler et al., "Unraveling Nanotubes: Field Emission from an Atomic Wire", *Science*, vol. 269, 1550 (1995).
de Heer, et al., "A Carbon Nanotube Field-Emission Electron Source", *Science*, vol. 270, 1179 (1995).
Saito et al., "Cathode Ray Tube Lighting Elements with Carbon Nanotube Field Emitters", *Jpn. J. Appl. Phys.,* vol. 37, L346 (1998).
Wang et al., "A nanotube-based field-emission flat panel display", *Appl. Phys. Lett.,* vol. 72, 2912 (1998).
Bonard et al., "Field emission from single-wall carbon nanotube films", *Appl. Phys. Lett*., vol. 73, 918 (1998).
D.A. Koester, et al., MUMPS™ Design handbook, Rev. 5.0 (2000).

* cited by examiner

ON-CHIP VACUUM TUBE DEVICE AND PROCESS FOR MAKING DEVICE

BACKGROUND OF THE INVENTION

1. Field of the Invention

The invention relates to microwave vacuum tube devices.

2. Discussion of the Related Art

Microwave vacuum tube devices, such as power amplifiers, are essential components of many modern microwave systems including telecommunications, radar, electronic warfare and navigation systems. While semiconductor microwave amplifiers are available, they generally lack the power capabilities required by most microwave systems. Microwave vacuum tube amplifiers, in contrast, can provide higher microwave power by orders of magnitude. The higher power levels of vacuum tube devices are the result of the fact that electrons can travel at a much higher velocity in a vacuum with much less energy losses than in a solid semiconductor material. The higher speed of electrons permits a use of the larger structure with the same transit time. A larger structure, in turn, permits a greater power output, often required for efficient operations.

Microwave tube devices typically operate by introducing a beam of electrons into a region where the beam interacts with an input signal, and deriving an output signal from the thus-modulated beam. See, e.g., A. S. Gilmour, Jr., Microwave Tubes, Artech House, 1986, 191–313. Microwave tube devices include gridded tubes (e.g., triodes, tetrodes, pentodes, and klystrodes), klystrons, traveling wave tubes, crossed-field amplifiers and gyrotrons. All these devices contain the basic components of a cathode structure, an interaction structure, and an output structure. (A grid is generally used in the cathode structure, to initiate emission from electron emitters, and the grid can also be used to modulate the electron emission to get a desired output. As used herein, grid indicates any structure that controls electron emission from the cathode, and the grid can have, for example, multiple apertures or a single aperture.)

These devices are typically formed by mechanical assembly of the individual components, e.g., aligning and securing the individual elements on a supporting structure. Unfortunately, such assembly is not efficient and cost-effective, and inevitably introduces some misalignment and asymmetry into the structure. Some attempts to address these problems have led to use of sacrificial layers in a rigid structure, i.e., a structure is rigidly built with layers or regions that are removed in order to expose or free the components of the device. See, e.g., U.S. Pat. No. 5,637,539 and I. Brodie and C. Spindt, "Vacuum microelectronics," *Advances in Electronics and Electron Physics*, Vol. 83 (1992). These rigid structures generally reflected an improvement, but still encountered formidable fabrication problems, such as alignment issues and parasitic effects. Thus, improved fabrication methods are desired.

Improvements in the emission source of such microwave tube devices are also desired. The usual source of electrons is a thermionic emission cathode, which is typically formed from tungsten that is either coated with barium or barium oxide, or mixed with thorium oxide. Thermionic emission cathodes must be heated to temperatures around 1000° C. to produce sufficient thermionic electron emission current, e.g., on the order of amperes per square centimeter. The necessity of heating thermionic cathodes to such high temperatures creates several problems. For example, the heating limits the lifetime of the cathodes, introduces warm-up delays, requires bulky auxiliary equipment for cooling, and tends to interfere with high-speed modulation of emission in gridded tubes.

An attractive alternative is field emission at room temperature, which is possible using suitable cold cathode materials. Conventional cold cathode materials are typically made of Spindt-type cathodes formed from either metal (such as Mo) or semiconductor (such as Si), with sharp tips in nanometer sizes. (See I. Brodie and C. Spindt, supra.) Unfortunately, while useful emission characteristics have been demonstrated for these materials, the control voltage required for emission is relatively high (around 100 V) because of their high work functions, and this high voltage operation both increases the damage incurred by the emitter tips and also requires a supply of significant power densities. In addition, fabrication is complicated and costly, particularly for uniform tips across a large area. Thus, vacuum microelectronic devices that incorporate Spindt cathodes tend to suffer from various drawbacks. As an alternative cold cathode material, carbon nanotubes have recently emerged as a potentially useful emitter material. Nanotubes' high aspect ratio (>1,000) and small tip radii of curvature (~10 nm), coupled with their high mechanical strength and chemical stability, make them particularly attractive as electron field emitters.

For these reasons, improved vacuum microelectronic device designs that avoid current problems are desired, particularly designs incorporating improved cold cathode electron emitters.

SUMMARY OF THE INVENTION

The invention relates to a unique design and fabrication process for microwave vacuum tube devices. The process of the invention provides such devices on a smaller scale and with better control of size, spacing, symmetry, and other parameters than is generally possible with current techniques. The process involves providing a structure having numerous structural regions that constitute the elements of the ultimate device, and numerous sacrificial regions. The structure is subjected to a treatment, e.g., an etch, to remove the sacrificial regions—referred to as a release step. A key feature of the invention is that one or more of the structural regions have flexural members that provide for movement of the regions upon such release. Specifically, the structural regions having these flexural members either move into place themselves, e.g., in a pop-up design, or, alternatively, become capable of being physically moved into place, e.g., by movement (typically rotation) around a flexural member (typically a hinge mechanism). This movement puts the elements of the device into the appropriate configuration. All the components of the device are capable of having such flexural members, including, e.g., a cathode structure, an input structure, an interaction structure, an output structure and/or a collection structure. And it is therefore possible for all the components of the device to be arranged using such flexural members, or for there to be some combination of structural regions with and without such members.

(Flexural member includes any structure that induces or allows movement of a structural region into its desired configuration in the device. Pop-up indicates that the structural region is induced to move upon release, without the need for external force. Hinge mechanism indicates one or more flexural members, e.g., a hinge, that allows the component to be moved, e.g., rotated, by applying external force. The cathode structure contains a cathode and one or more grids. The input structure is where the microwave signal to be amplified is introduced (in some configurations, the input structure is a grid of the cathode structure). The interaction structure is where the electron beam interacts with the microwave signal to be amplified. The output structure is where the amplified microwave power is removed. The collection structure is where the electron beam is collected after the amplified microwave power has been removed.)

In one embodiment, reflected in FIG. 1A, the release step provides a device substrate comprising a cathode electrode, a grid, and an anode, each being substantially planar with the device substrate surface and attached to the device substrate by a flexural member, e.g., a hinge mechanism. A mask is placed over portions of the device substrate such that the cathode electrode surface is exposed while other components on the device substrate are covered, and electron emitters are formed on the exposed cathode electrode surface. The mask is then removed, and the cathode, grid, and anode are rotated, around the flexural member, such that their surfaces are substantially parallel with each other. (Removal of the mask includes complete detachment from the substrate, as well as simply rotating an attached mask away from the device components.)

The resultant devices are on a scale not typically attainable by conventional techniques. For example, in conventional gridded tubes the cathode electrode and grid typically have surfaces greater than $10^7$ $\mu m^2$, whereas according to the invention, it is possible to form a cathode electrode and grid having surfaces of $10^2$ to $10^6$ $\mu m^2$. Similarly, it is possible to attain extremely small cathode-grid spacings in the invention, e.g., as low as 3 μm, typically less than 50 μm, whereas current devices typically have a gap greater than 50 μm. Devices of this size are not only useful for typical applications of microwave tubes, such as wireless base stations, but are also potentially useful in smaller-scale applications such as wireless handsets. While a particular anode configuration is reflected in the above embodiment, the formation techniques of the invention are applicable to a wide variety of gridded microwave tube types, including triodes, tetrodes, pentodes, and klystrodes, as well as other microwave tube devices having a variety of cathode, input, interaction, output, and collection structures. It is also possible to simultaneously form numerous devices on a single substrate, and to interconnect at least a portion of such devices to provide an integrated microwave circuit.

DETAILED DESCRIPTION OF THE INVENTION

Figure 1A:
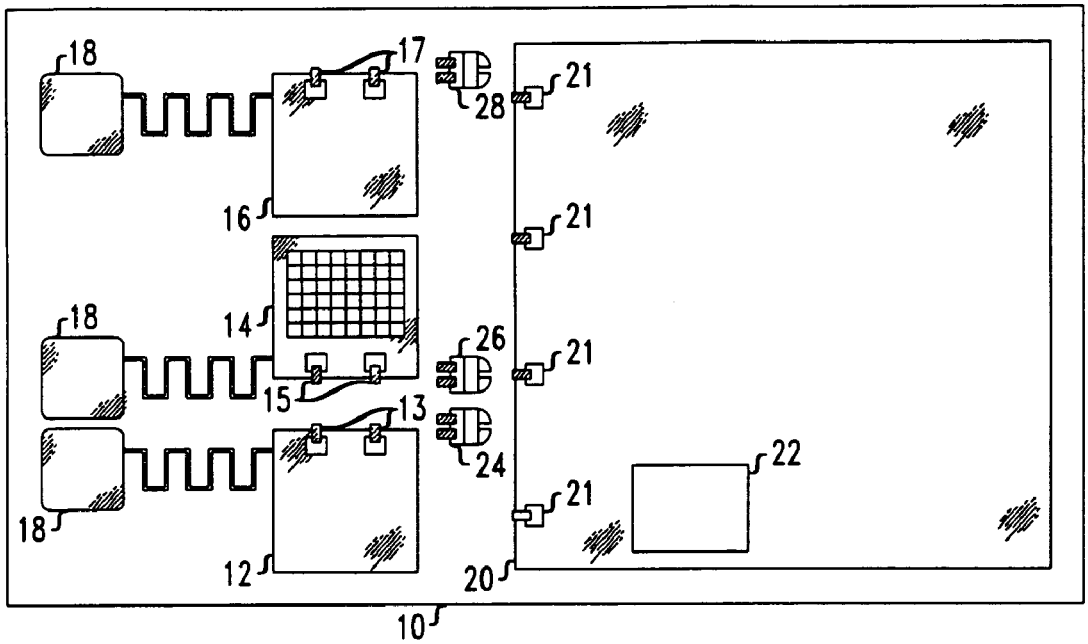
FIGS. 1A to 1C illustrate fabrication steps according to an embodiment of the invention.

In one embodiment, a gridded microwave tube is formed as follows. The principles used in the fabrication are those applicable to a variety of microelectromechanical systems (MEMS). Detailed fabrication information is available from, for example, the Design Handbook of MUMPs (Multi-User MEMS Processes), a commercial program designed for general purpose micromachining, available from Cronos Integrated Microsystems, Research Triangle Park, N.C.

A 100 mm diameter, n-type, (100) oriented silicon wafer, with a resistivity of 1 to 2 ohm-cm is used as the initial substrate. The surface of the wafer is heavily doped with phosphorus in a standard diffusion furnace, using POCl as the dopant source. The dopant helps to reduce or prevent charge feed through to the substrate from electrostatic devices on the surface.

Next, a 600 nm low-stress LPCVD (low pressure chemical vapor deposition) silicon nitride layer is deposited on the wafers as an electrical isolation layer. This is followed by the deposition of a 500 nm LPCVD polysilicon film—Poly 0. (It is also possible to use single crystal silicon, which provides increased thermal efficiency due to its higher thermal conductivity.) Poly 0 is then patterned by conventional photolithography, e.g., coating the wafers with photoresist, exposing the photoresist with the appropriate mask, and developing the exposed photoresist to create a pattern, and etching the pattern into the underlying layer using an RIE (Reactive Ion Etch) system.

A 2.0 μm phosphosilicate glass (PSG) sacrificial layer is then deposited by LPCVD and annealed at 1050° C. for 1 hour in argon. (Sacrificial indicates that the layer is not intended to be part of the final device structure, but is instead intended to be removed to leave the desired micromechanical structures. Materials other than PSG are possible.) This layer of PSG, known as First Oxide, is removed at the end of the process to free the first mechanical layer of polysilicon. The sacrificial layer is photolithographically patterned with a mask, e.g., a DIMPLES mask, as known in the art, and the pattern is then transferred into the sacrificial PSG layer by RIE. The nominal depth of the dimples is 750 nm.

The wafers are then lithographically patterned with a third mask layer—ANCHOR1. After etching ANCHOR1 to provide anchor holes to be filled by the first structural layer, that first structural layer of polysilicon (Poly 1) is deposited at a thickness of 2.0 μm, and fills the anchor holes. A 200 nm layer of PSG is deposited over the polysilicon and the wafer is annealed at 1050° C. for 1 hour. The anneal dopes the polysilicon with phosphorus from the PSG layers both above and below it. The anneal also serves to significantly reduce the net stress in the Poly 1 layer. The Poly 1 (and its PSG masking layer) is lithographically patterned using a mask designed to form the first structural layer POLY1. The PSG layer is etched to produce a hard mask for the subsequent polysilicon etch. The hard mask is more resistant to the polysilicon etch chemistry than the photoresist and ensures better transfer of the pattern into the polysilicon. After etching the polysilicon, the photoresist is stripped and the remaining oxide hard mask is removed by RIE.

After Poly 1 is etched, a second PSG layer (Second Oxide) is deposited and annealed. The Second Oxide is patterned using two different etch masks with different objectives. The POLY1_POLY2_VIA level provides for etch holes in the Second Oxide down to the Poly 1 layer. This provides a mechanical and electrical connection between the Poly 1 and Poly 2 layers. The POLY1_POLY2_VIA layer is lithographically patterned and etched by RIE. The ANCHOR2 level is provided to etch both the First and Second Oxide layers in one step, thereby eliminating any misalignment between separately etched holes. More importantly, the ANCHOR2 etch eliminates the need to make a cut in First Oxide unrelated to anchoring a Poly 1 structure. The ANCHOR2 layer is lithographically patterned and etched by RIE in the same way as POLY1_POLY2_VIA.

The second structural layer, Poly 2, is then deposited (1.5 μm thick) followed by the deposition of 200 nm of PSG. As with Poly 1, the thin PSG layer acts as both an etch mask and dopant source for Poly 2. The wafer is annealed for one hour at 1050° C. to dope the polysilicon and reduce the residual film stress. The Poly 2 layer is lithographically patterned with a seventh mask (POLY2), and the PSG and polysilicon layers are etched by RIE using the same processing conditions as for Poly 1. The photoresist is then stripped and the masking oxide is removed.

The final deposited layer is a 0.5 μm metal layer that provides for probing, bonding, and/or electrical routing and connection. The wafer is patterned lithographically with the eighth mask (METAL) and the metal is deposited and patterned using lift-off to provide a desired metal pattern, e.g., metal conductors.

Once the structural fabrication is completed, the release of the sacrificial regions is performed by immersing the chip in a bath of 49% HF (room temperature) for 1.5 to 2 minutes. This is followed by several minutes in DI water and then alcohol (to reduce stiction—i.e., the sticking of the structural members to the surrounding material) followed by at least 10 minutes in an oven at 150° C.

FIG. 1A shows a device structure subsequent to the above process steps, for a triode device configuration. On the surface of a device substrate 10, e.g., a silicon nitride surface on a silicon wafer, are formed a cathode electrode 12 attached to the device substrate 10 surface by a hinge mechanism 13 (formed by two hinges), a grid 14 attached to the device substrate 10 surface by a hinge mechanism 15, and an anode 16 attached to the device substrate 10 surface by a hinge mechanism 17. Also on the substrate 10 surface are contacts 18 electrically connected to the cathode electrode 12, grid 14, and anode 16. The contacts 18 and connective wiring are typically polysilicon coated with gold, although other materials are possible. Design of the connective wiring must take into account the subsequent rotation of the cathode electrode 12, grid 14, and anode 16, to avoid breakage and/or reliability problems. The substrate 10 also has three locking mechanisms 24, 26, 28, which secure the cathode 12, grid 14, and anode 16 in an upright position, as discussed below. A mask 20 is also attached to the substrate 10 by a hinge mechanism 21, e.g., made up of four hinges. The mask contains an opening 22 such that when the mask is rotated on its hinges to cover the other components of the device substrate surface, the cathode electrode 12 remains exposed. It is then possible to form the cathode emitter structure without forming emitters on any other portion of the device. The emitter structure is discussed in more detail below. All these components, including the hinges, are formed by a micromachining process such as discussed above.

Figure 1B:
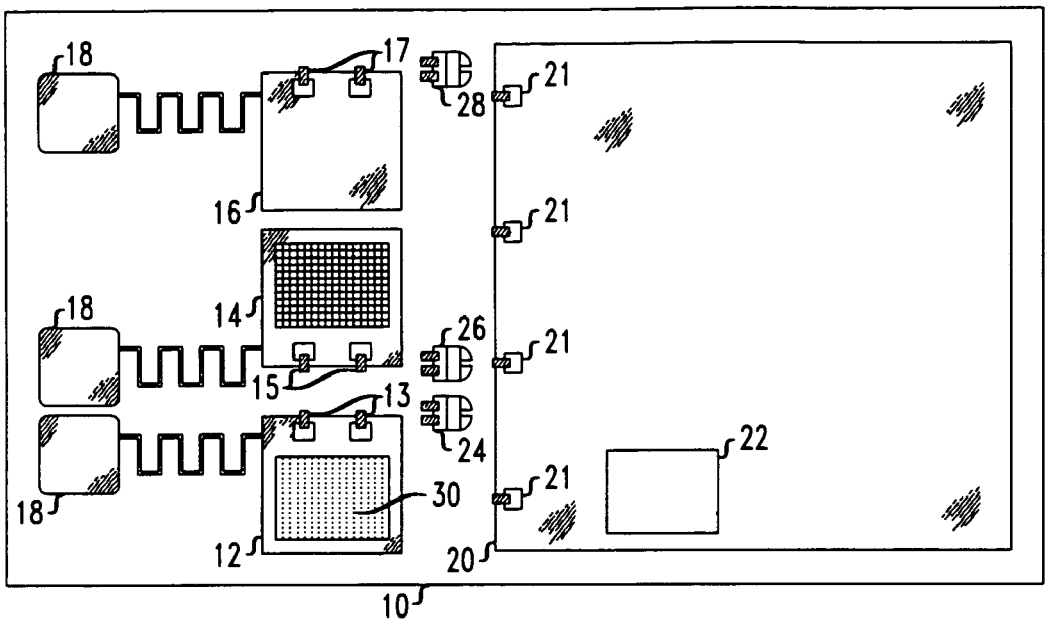

FIG. 1B shows the structure of FIG. 1A, without the mask, after emitters 30 have been formed on the cathode electrode 12. The cathode electrode 12, with attached emitters 30, the grid 14, and the anode 16, are then mechanically rotated on their hinges, 13, 15, 17 and brought to an upright position—substantially perpendicular to the surface of the device substrate 10. The locking mechanisms 24, 26, 28 are then rotated on their hinges to secure the cathode electrode 12, grid 14, and anode 16 in these upright positions.

Figure 1C:
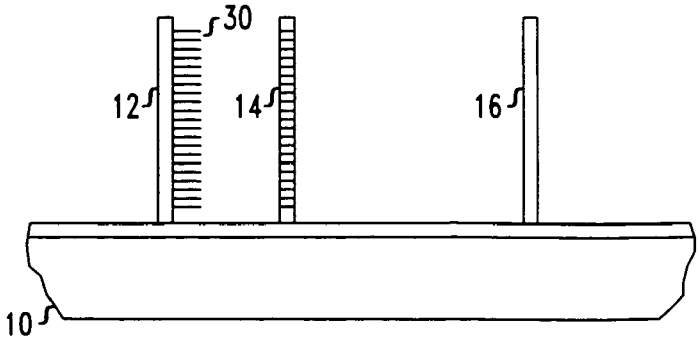

A cross-section of the resulting structure is shown in FIG. 1C, with the cathode electrode 12, the grid 14, and the anode 16 arranged such that their surfaces are substantially parallel to each other, and substantially perpendicular to the surface of the device substrate 10. Vacuum sealing and packaging of the structure are then performed by conventional techniques.

Other uses of flexural members are also possible, e.g., pop-up members that induce movement of the structural regions into the desired configuration, upon release, without the need for external force. Combinations of pop-up and hinged mechanisms are similarly possible.

In operation, as discussed in Gilmour, supra, a weak microwave signal to be amplified is applied between the grid and the cathode. The signal applied to the grid controls the number of electrons drawn from the cathode. During the positive half of the microwave cycle, more electrons are drawn. During the negative half, fewer electrons are drawn. This modulated beam of electrons passes through the grid and goes to the anode. A small voltage on the grid controls a large amount of current. As this current passes through an external load, it produces a large voltage, and the gridded tube thereby provides gain. Because the spacing between the grid and the cathode can be controlled to be very close, a triode (or other gridded tube) made according to the invention is expected to be capable of operating at very high frequencies, of 5 GHz or more Variations of these device structures are also possible. For example, to reduce grid heating caused by electrons impacting the grid, it is possible to use a shadow grid placed directly on the cathode surface. The shadow grid is identical to the structure of the active grid, and covers or blocks the emitters directly underneath the active grid material, thereby preventing emitting electrons from impacting the grid. It is also possible to selectively form the emitters on the cathode substrate such that few or no emitters are located beneath the grid wires, such that emission takes place primarily through the grid apertures.

It is apparent that other gridded tube designs such as a tetrode (adding another grid between the control grid and the anode to eliminate grid current induced by changes in anode potential) and a klystrode (using a resonant cavity anode to couple the output power) are able to be constructed in a similar fashion. Numerous other designs are also possible, including pentodes, traveling wave tubes, klystrons, and even displays. Vertical or horizontal arrangement on a substrate is possible. It is also apparent that the technique of the invention facilitates formation of numerous devices simultaneously on a single chip, and/or integrated on a single chip to form part of a complex microwave circuit. The fabrication techniques of the invention are similarly able to provide more symmetrical and balanced components in a microwave system, which contribute to improved accuracy and noise control than conventional designs.

A variety of cold cathode emitter materials are possible, including carbon nanotubes, diamond, and amorphous carbon. Carbon nanotubes are particularly attractive as field emitters because their high aspect ratio (>1,000), one-dimensional structure, and small tip radii of curvature (~10 nm) tend to effectively concentrate the electric field. In addition, the atomic arrangement in a nanotube structure imparts superior mechanical strength and chemical stability, both of which make nanotube field emitters robust and stable. It is possible to prepare carbon nanotubes by a variety of techniques, including carbon-arc discharge, chemical vapor deposition via catalytic pyrolysis of hydrocarbons, laser ablation of a catalytic metal-containing graphite target, or condensed-phase electrolysis. Depending on the method of preparation and the specific process parameters, the nanotubes are produced multi-walled, single-walled, or as bundles of single-walled tubules, and can adopt various shapes such as straight, curved, planar-spiral and helix. Carbon nanotubes are typically grown in the form of randomly oriented, needle-like or spaghetti-like mats. However, oriented nanotube structures are also possible, as reflected in Ren et al., *Science*, Vol. 282, 1105, (1998); Fan et al., *Science*, Vol. 283, 512 (1999).

Carbon nanotube emitters are discussed, for example, in Rinzler et al., *Science*, Vol. 269, 1550 (1995); De Heer et al., *Science*, Vol. 270, 1179 (1995); Saito et al., *Jpn. J. Appl. Phys.*, Vol. 37, L346 (1998); Wang et al., *Appl. Phys. Lett.*, Vol. 70, 3308, (1997); Saito et al., *Jpn. J. Appl. Phys*., Vol. 36, L1340 (1997); Wang et al., *Appl. Phys. Lett*., Vol. 72, 2912 (1998); and Bonard et al., *Appl. Phys. Lett*., Vol. 73, 918 (1998).

Techniques for forming nanotube field emitter structures, with both oriented and non-oriented nanotubes structures are also described in U.S. Pat. Nos. or application Ser. No. 6,250,984, 6,283,812, 6,630,772, 09/351,537, and 6,277,318, the disclosures of which are incorporated by reference.

As reflected in these techniques, it is possible to form carbon nanotube emitters on a substrate by either in-situ growth or post-deposition spraying techniques. For in-situ growth in the invention, the device substrate, with mask in place over the components other than the cathode electrode surface, is generally placed in a chemical vapor deposition chamber, and pre-coated with a thin layer (e.g., 1–20 nm thick) of catalyst metal such as Co, Ni or Fe (or formed from such a metal). The gas chemistry is typically hydrocarbon or carbon dioxide mixed with hydrogen or ammonia. Depending on specific process conditions, it is possible to grow the nanotubes in either an aligned or random manner. Optionally, a plasma enhanced chemical vapor deposition technique is used to grow highly aligned nanotubes on the substrate surface, as disclosed in co-assigned U.S. Pat. No. 6,277,318. Other techniques are also possible.

In a typical post-deposition technique, reflected, for example, in U.S. Pat. No. 6,630,772 pre-formed and purified nanotube powders are mixed with solvents and optionally binders (which are pyrolized later) to form a solution or slurry. The mixture is then disposed, e.g., dispersed by spray, onto the masked device substrate in which the cathode electrode surface is exposed. The cathode electrode optionally is provided with a layer of a carbon dissolving element (e.g., Ni, Fe, Co) or a carbide forming element (e.g., Si, Mo, Ti, Ta, Cr), to form a desired emitter structure. Annealing in either air, vacuum or inert atmosphere is followed to drive out the solvent, leaving a nanotube emitter structure on the substrate. And where the carbon dissolving or carbide forming elements are present, annealing promotes improved adhesion. Other post-deposition techniques are also possible.

The diameter of the field-emitting nanotubes is typically 1 to 300 nm. The length of the nanotubes is typically 0.05 to 100 μm. To maintain the small gap between the cathode and the grid, and thereby achieve a reduced transit time and a higher operating frequency, the nanotubes advantageously exhibit a relatively uniform height, e.g., at least 90% of the nanotubes have a height that varies no more than 20% from the average height.

Because of the nanometer scale of the nanotubes, the nanotube emitters provide many potential emitting points, typically more than $10^9$ emitting tips per square centimeter assuming a 10% area coverage and 10% activated emitters from 30 nm (in diameter) sized nanotubes. The emitter site density in the invention is typically at least $10^3/cm^2$, advantageously at least $10^4/cm^2$ and more advantageously at least $10^5/cm^2$. The nanotube-containing cathode requires a turn-on field of less than 2 V/μm to generate 1 nA of emission current, and exhibits an emission current density of at least 0.1 $A/cm^2$, advantageously at least 0.5 $A/cm^2$, at an electric field of 5 to 50 V/μm.

EXAMPLE

Figure 2:
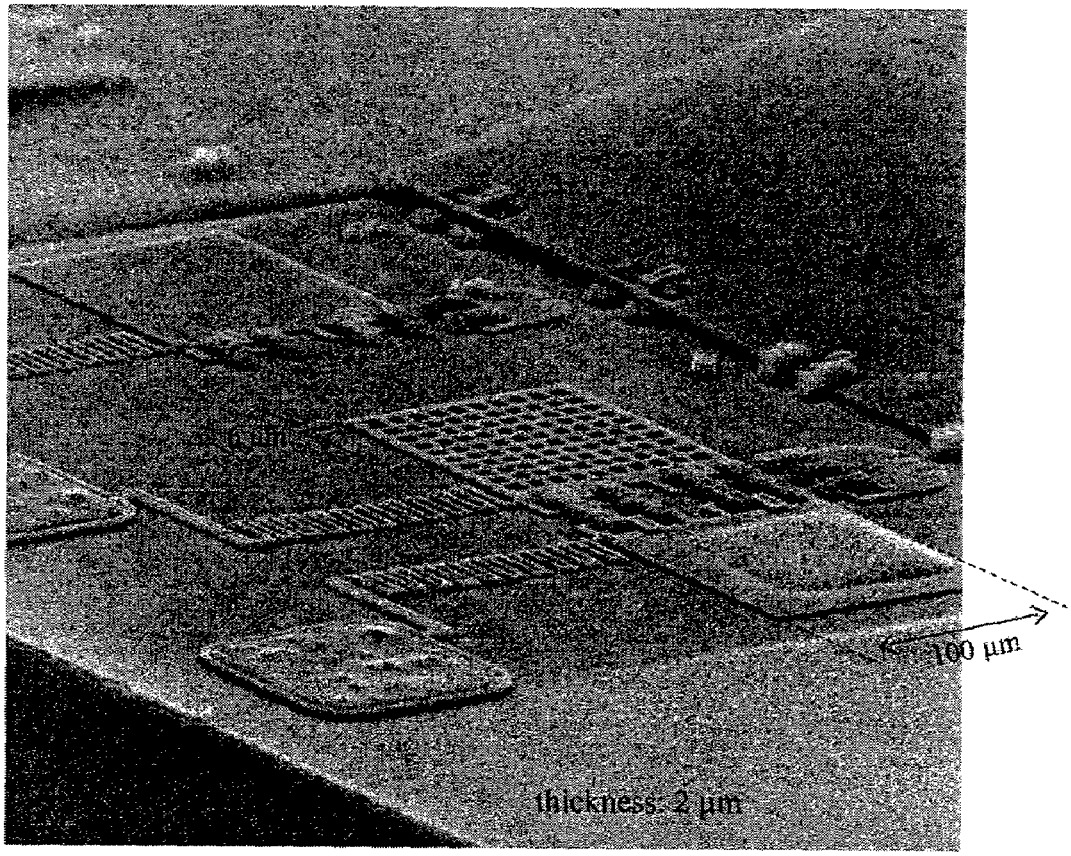
FIG. 2 shows an actual device substrate surface made according to an embodiment of the invention.

FIG. 2 shows a device substrate fabricated according to the invention. The device components were fabricated by the procedure presented above. The cathode, grid, and anode had surfaces 100 μm×100 μm, and were 2 μm thick. The apertures of the grid were 6 μm across (in the direction parallel to the grid wires). The gap between the cathode and grid, when raised to a position perpendicular to the device substrate, was about 40 μm.

Nanotube emitters were formed on the cathode electrode by a microwave plasma enhanced chemical vapor deposition technique. Specifically, after the mask was placed over the device substrate—leaving the cathode electrode surface exposed, an approximately 2 nm layer of cobalt was sputter-deposited through the opening onto the cathode electrode. The structure was then transferred in air to a microwave plasma enhanced chemical vapor deposition (MPECVD) system to start the nanotube growth. The structure was heated to 800° C. in flowing hydrogen in 10 minutes. A microwave plasma of ammonia ($NH_3$) and 10 to 30 vol. % acetylene ($C_2H_2$) was then ignited to start the nanotube growth. The growth process lasted about 2 minutes. The structure was then cooled to room temperature, again in flowing hydrogen. As shown in FIG. 2, the nanotubes grown under these conditions were aligned. Because the nanotube growth is highly selective, with growth occurring only in areas where cobalt is present, the nanotubes were substantially confined on the cathode in an area defined by the opening in the mask through which cobalt is deposited.

Other embodiments of the invention will be apparent to those skilled in the art from consideration of the specification and practice of the invention disclosed herein.

What is claimed is:

1. A device comprising a vacuum microelectromechanical device that comprises:

a device substrate;

a cathode attached to the device substrate, the cathode comprising electron emitters and having a surface;

a cathode emission control grid attached to the device substrate, the cathode emission control grid having a surface and configured to modulate the electrons drawn from the cathode; and an output structure, wherein the cathode surface and the grid surface are substantially parallel, and wherein the cathode, the grid, or the cathode and the grid are attached to the device substrate by one or more flexural members.

2. The device of claim 1, wherein the cathode and the grid are attached to the device substrate by the one or more flexural members.

3. The device of claim 1, wherein the cathode surface and the grid surface are substantially perpendicular to the device substrate surface.

4. The device of claim 3, wherein the cathode and the grid are held in the substantially perpendicular position by locking mechanisms, the locking mechanisms attached to the device substrate by one or more flexural members.

5. The device of claim 1, wherein the output structure comprises an anode attached to the device substrate, wherein the anode has a surface that is substantially parallel to the cathode surface and the grid surface.

6. The device of claim 5, wherein the anode is attached to the device substrate by the one or more flexural members.

7. The device of claim 1, wherein the device further comprises one or more additional grids attached to the device substrate by one or more flexural members.

8. The device of claim 1, wherein the cathode comprises carbon nanotube emitters.

9. The device of claim 1, wherein the surfaces of the cathode and the grid are $10^6$ $\mu m^2$ or less.

10. The device of claim 1, wherein the spacing between the cathode and the grid is less than 50 μm.

11. The device of claim 1, wherein the vacuum microelectromechanical device is a triode device, a tetrode device, a pentode device, a klystrode device, a traveling wave tube device, or a klystron device.

12. A plurality of vacuum microelectromechanical devices, each of the plurality of vacuum microelectromechanical devices comprising:

a device substrate;

a cathode attached to the device substrate, the cathode comprising electron emitters and having a surface;

a cathode emission control grid attached to the device substrate, the cathode emission control grid having a surface and configured to modulate the electrons drawn from the cathode; and an output structure, wherein the cathode surface and the grid surface are substantially parallel, and wherein the cathode, the grid, or the cathode and the grid are attached to the device substrate by one or more flexural members.

13. The device of claim 12, wherein at least a portion of the plurality of vacuum microelectromechanical devices are interconnected to provide an integrated electronic circuit.

* * * * *